US012305547B2

(12) United States Patent
Komi et al.

(10) Patent No.: US 12,305,547 B2
(45) Date of Patent: May 20, 2025

(54) SOUND ATTENUATOR AS WELL AS ELEMENTS AND A METHOD OF PRODUCTION THEREOF

(71) Applicant: Teknologian tutkimuskeskus VTT Oy, Espoo (FI)

(72) Inventors: Erin Komi, Espoo (FI); Jukka Tanttari, Espoo (FI); Antti Hynninen, Espoo (FI); Seppo Uosukainen, Espoo (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 346 days.

(21) Appl. No.: 17/426,195

(22) PCT Filed: Jan. 29, 2020

(86) PCT No.: PCT/FI2020/050043
§ 371 (c)(1),
(2) Date: Jul. 28, 2021

(87) PCT Pub. No.: WO2020/157382
PCT Pub. Date: Aug. 6, 2020

(65) Prior Publication Data

US 2022/0099006 A1 Mar. 31, 2022

(30) Foreign Application Priority Data

Jan. 29, 2019 (FI) ..... 20195054

(51) Int. Cl.
*F01N 1/12* (2006.01)
*F01N 1/08* (2006.01)

(52) U.S. Cl.
CPC ..... *F01N 1/12* (2013.01); *F01N 1/086* (2013.01); *F01N 2450/20* (2013.01); *F01N 2490/16* (2013.01)

(58) Field of Classification Search
CPC ..... F01N 1/12; F01N 1/086; F01N 2450/20; F01N 2490/16; F01N 2450/06; F28F 2009/222
(Continued)

(56) References Cited

U.S. PATENT DOCUMENTS 2,445,045 A 7/1948 Strachan
3,235,003 A * 2/1966 Smith ..... F01N 13/18 181/239
(Continued)

FOREIGN PATENT DOCUMENTS

CA 2094168 A1 10/1994
EP 2292967 A2 3/2011
(Continued)

*Primary Examiner* — Forrest M Phillips
*Assistant Examiner* — Jennifer B. Olson
(74) *Attorney, Agent, or Firm* — Laine IP Oy

(57) ABSTRACT

In the present disclosure is proposed a novel sound attenuating element for, at least in part, providing adequate or preferably improved sound attenuating properties without excessively impeding flow while being susceptible to automated or machine assisted manufacturing or for providing the public with a useful alternative. The novel sound attenuating element is formed at least in part by an assembly of a plurality of components which are successively connected to each other, which each exhibit a curved shape, and which form at least one non-planar ruled surface when assembled.

19 Claims, 7 Drawing Sheets

(58) Field of Classification Search
USPC ..... 181/279, 280, 223, 281, 282; 156/156, 156/63
See application file for complete search history.

(56) References Cited

U.S. PATENT DOCUMENTS

| | | | | | |
|---|---|---|---|---|---|
| 1,093,630 | A | | 12/1967 | Cloyd | |
| 4,050,539 | A | * | 9/1977 | Kashiwara | F01N 1/06 181/268 |
| 8,312,962 | B2 | * | 11/2012 | Melcher | F01N 1/081 181/227 |
| 9,851,166 | B2 | * | 12/2017 | Petersen | F41A 21/30 |

FOREIGN PATENT DOCUMENTS

| | | | | | |
|---|---|---|---|---|---|
| FR | 2949595 | A1 | * | 3/2011 | F01N 1/12 |
| GB | 297871 | A | * | 1/1928 | |
| GB | 694376 | A | * | 7/1953 | |
| GB | 1093630 | A | | 12/1967 | |
| JP | S60249612 | A | | 12/1985 | |

* cited by examiner

SOUND ATTENUATOR AS WELL AS ELEMENTS AND A METHOD OF PRODUCTION THEREOF

FIELD

The present disclosure relates to the attenuating sound carried by a gaseous current. In particular, the present disclosure relates to sound attenuators for in-duct sound attenuating.

BACKGROUND

In-duct sound attenuator design is a complex balancing act of minimizing sound while optimizing flow. A myriad of different approaches is known to inhibit the propagation of pressure waves in a gaseous flow, such as the exhaust gas flow of an internal combustion engine, without introducing an excessive back pressure that could be detrimental to the flow. One effective solution is to use a helical sound attenuating element provided in a duct for carrying a gaseous flow. Such solutions are described in, e.g., CA 2094168 A1 and GB 694376 A which disclose an in-duct attenuating elements being bent to a helicoid. The attenuating elements require very delicate manual labor or advanced machinery to achieve the desired shape.

There remains a need to further develop in-duct attenuating elements that would not only provide adequate or preferably improved sound attenuating properties without excessively impeding flow but also be susceptible to automated or machine assisted manufacturing.

SUMMARY OF THE INVENTION

A novel sound attenuating element is therefore proposed to at least partly meet the afore-described need or to provide the public with a useful alternative to existing sound attenuating elements. The novel sound attenuating element is formed at least in part by an assembly of a plurality of components which are successively connected to each other, which each exhibit a curved shape, and which form at least one non-planar ruled surface when assembled. Every second component in the assembly extends in a non-straight angle in respect to the successive component.

An enclosure for a sound attenuator is also proposed for a similar purpose. The enclosure features at least one spiral guide which is configured to receive a plurality of components in a successively layered fashion so as to create at least one non-planar ruled surface for contacting a gaseous current.

Further, a sound attenuator is proposed for a similar purpose. The sound attenuator features a sound attenuating element as described above installed into an enclosure as described above.

Finally, a method of producing such a sound attenuator is proposed taking advantage of the fact that the sound attenuating element is assembled inside the enclosure with a spiral guide.

Considerable benefits are gained with aid of the novel proposition.

By constructing the sound attenuating element as an assembly from a plurality of components in a successively layered fashion, the element may be manufactured without the need for a complex arrangement for bending a sheet substrate. This, in turn, facilitates simple manufacturing which may be automated or machine assisted. On the other hand, the non-planar ruled surface, such as a helicoid, is very advantageous in attenuating sound without impeding flow through the sound attenuator.

The same can be said about the enclosure which, by including the guide, can facilitate simple insertion of components which assume the desired shape by being bent during the passage along the guide. The insertion of the components may be rather easily automated thus facilitating manufacturing.

According to one embodiment, the elements may feature micro-perforations. Such perforations further improve the sound attenuating ability of the sound attenuating element. The micro-perforated components may, however, be assembled in a machine assisted fashion without the need for additive manufacturing, such as 3D printing, which may not be suitable for producing perforations of a very small diameter. In addition additive manufacturing may not be advantageous when producing large metal objects. On the other hand, easily printed plastics may not survive harsh conditions often encountered in silencing applications. The novel proposition including micro-perforations avoids or at least mitigates these disadvantages.

BRIEF DESCRIPTION OF THE DRAWINGS

In the following certain exemplary embodiments are described in greater detail with reference to the accompanying drawings in which.

EMBODIMENTS

In the present context, the term "axis" is referred to as the straight or curved dimension in which certain elements extend.

In the present context, the term "micro-perforation" includes but is not limited to perforations or otherwise produced holes with a diameter of 1 mm or less, such as in the range of 0.05 to 0.5 mm.

Figure 1:
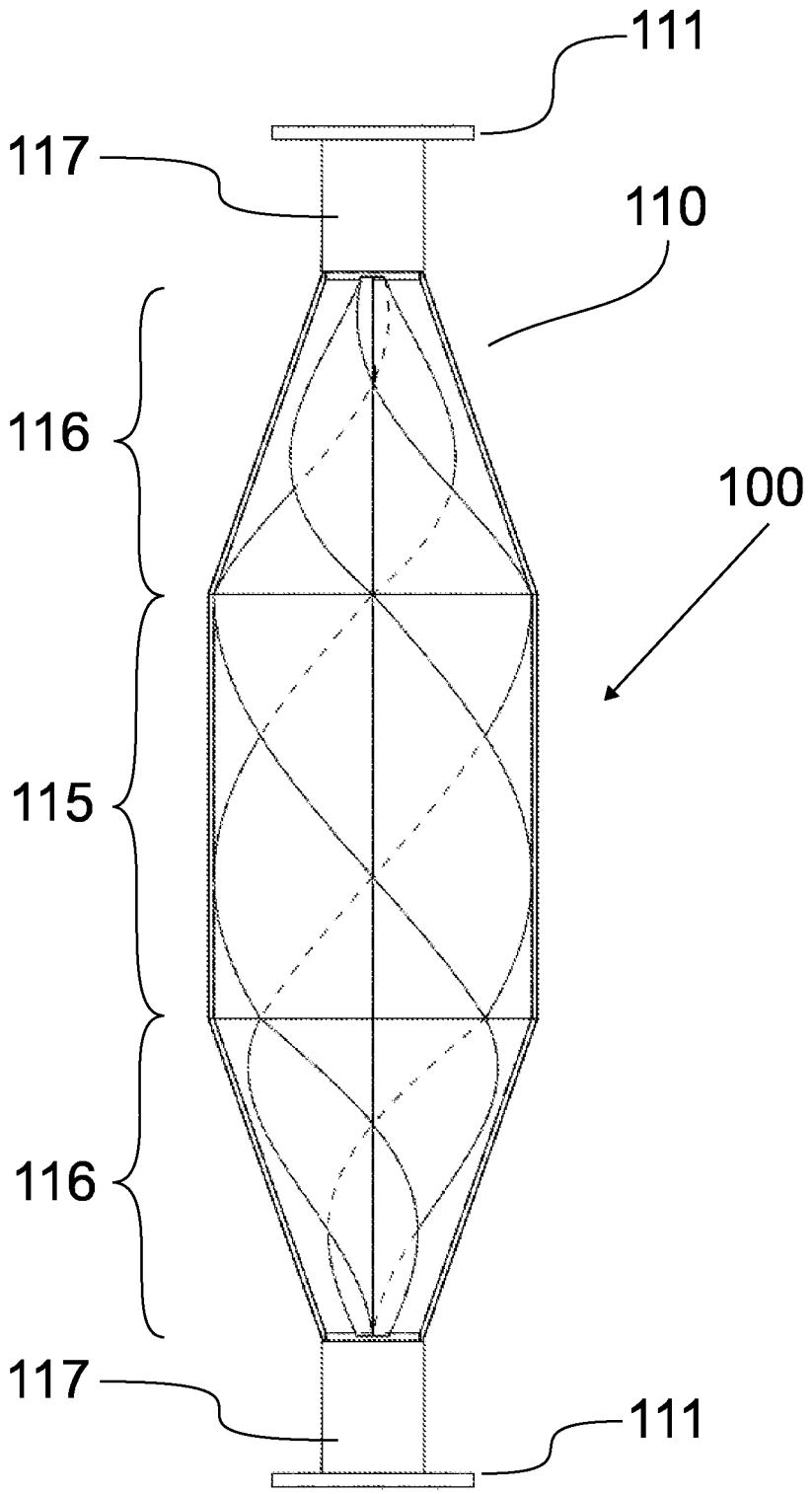
FIG. 1 illustrates a partial cross-sectional view of a sound attenuator in accordance with at least some embodiments.

FIG. 1 shows exemplification of a sound attenuator 100 employing a novel sound attenuating element enclosed in a novel enclosure 110. In particular, the sound attenuator 100 is an in-duct attenuator, such as an exhaust silencer forming part of the exhaust system of an ICE vehicle. The enclosure 110 features an elongated envelope extending between two attachment interfaces, such as flanges 111. The outer surface of the envelope may be smooth. The inner surface may include a guide, the purpose and structure will become apparent here after. The enclosure 110 houses a sound attenuating element 120 which is designed to contact gaseous currents and to attenuate sound carried by such currents.

Figure 2:
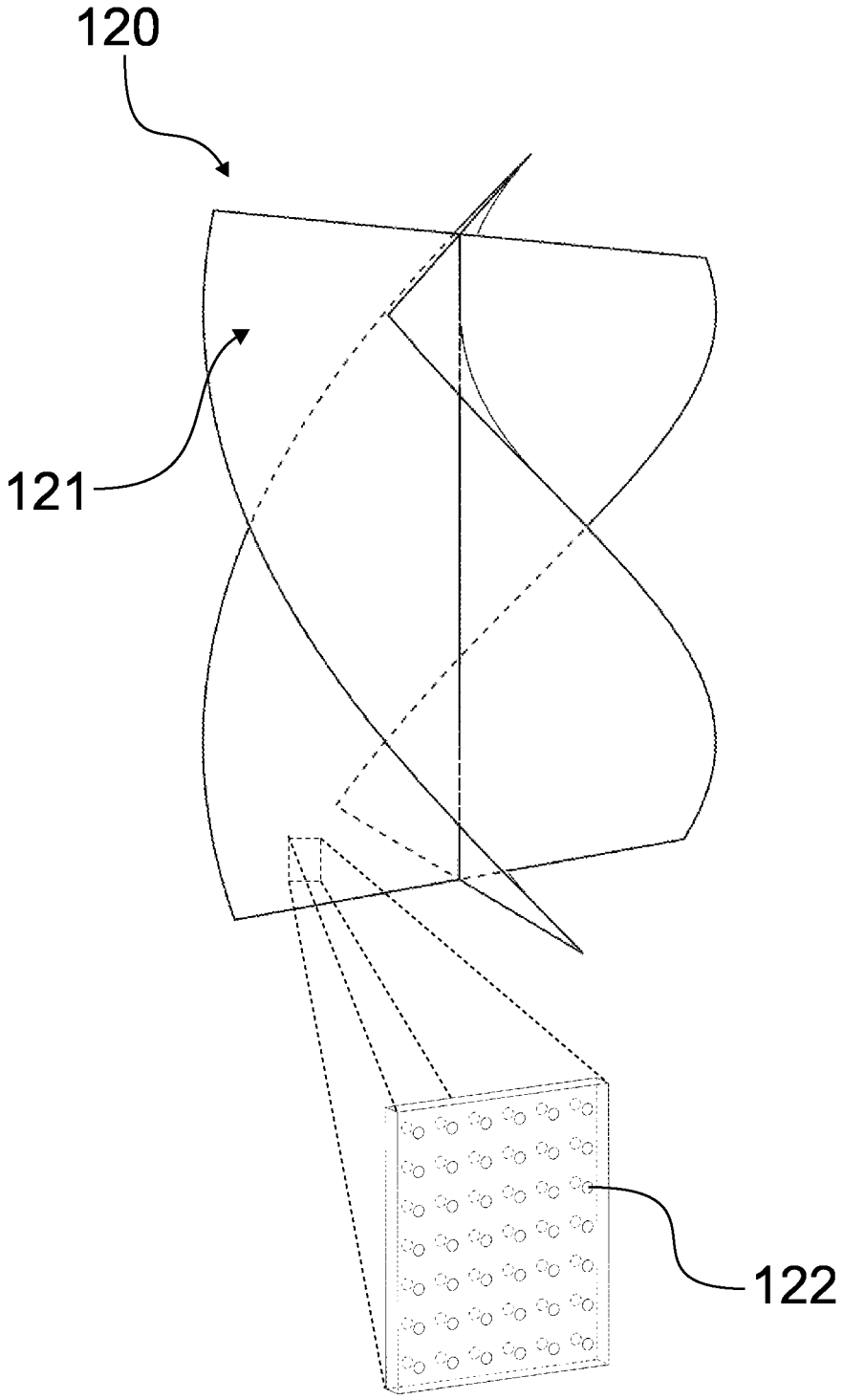
FIG. 2 illustrates a perspective view of the sound attenuating element of FIG. 1.
Figure 3:
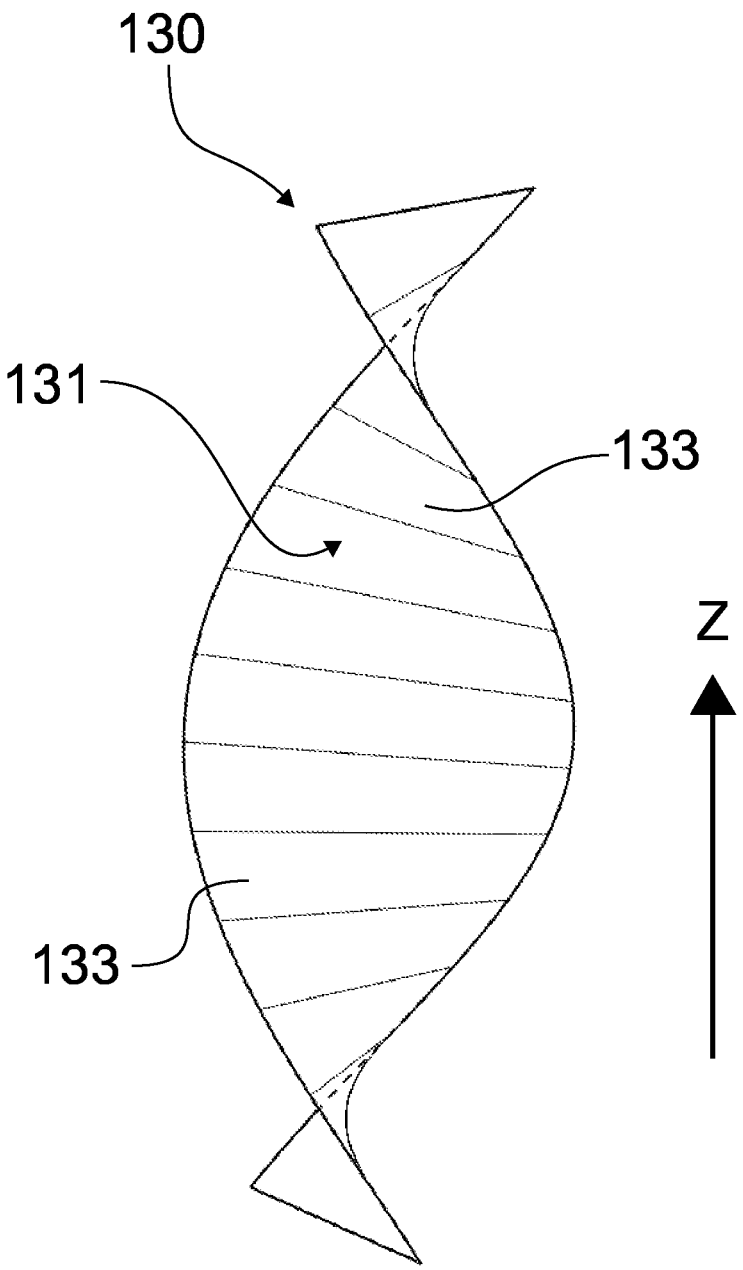
FIG. 3 illustrates a perspective view of a sound attenuating element in accordance with at least some embodiments.

Turning now to FIG. 2, which shows the sound attenuating element 120 of FIG. 1 in isolation, it may be seen that the attenuating element 120 has at least one blade which features at least one non-planar ruled surface. The example of FIG. 2 has four blades angularly disposed at successive 90 degree angles from each other. FIG. 3 shows another example of a sound attenuating element 130 with a solitary blade. Let us first consider the embodiment of FIG. 3.

The sound attenuating element 130 of FIG. 3 is formed at least in part by an assembly of components 133 which are successively connected to each other. The components 133 take the form strips. The strips are made from an elastic material in the sense that they are configured to undergo some visually noticeable deformation through bending without breaking. Practical examples of the material of the components 133 include metals, such as steel and aluminium as well as metal alloys, and plastics, composite materials. The components 133 are successively layered as the assembly along a first axis Z which may be straight or curved. The components 133 may have an elongated shape such that the dimension of elongation extends perpendicularly to the first axis Z. When assembled, the components 133 are also curved about the dimension of elongation so as to form a non-planar ruled surface 131. In particular, the surface 131 that is formed by the assembled components is a piece-wise ruled surface. More particularly, the sound attenuating element 130 has a helicoid shape. The assembly of components 133 may also include an attachment pieces or material, such as adhesive or sealing material, between the components 133 for ensuring contact there between. Alternatively, the components 133 may simply lay on top of each other in direct contact. The components may contain micro-perforations so as to cause absorption of sound due to viscous and thermal losses.

As is apparent from FIG. 3, components 113 are elongated in a dimension that is perpendicular to the axis Z in which the components are stacked or layered. The components 113 has a height along the first axis Z, length in one dimension perpendicular to the first axis Z, and a thickness in another dimension perpendicular to the first axis Z. In other words, the components exhibit a shorter dimension (height) along the first axis Z than in a dimension perpendicular to the first axis Z (length). This means that the components 113 engage one another at the longest dimension of extension.

Figure 5:
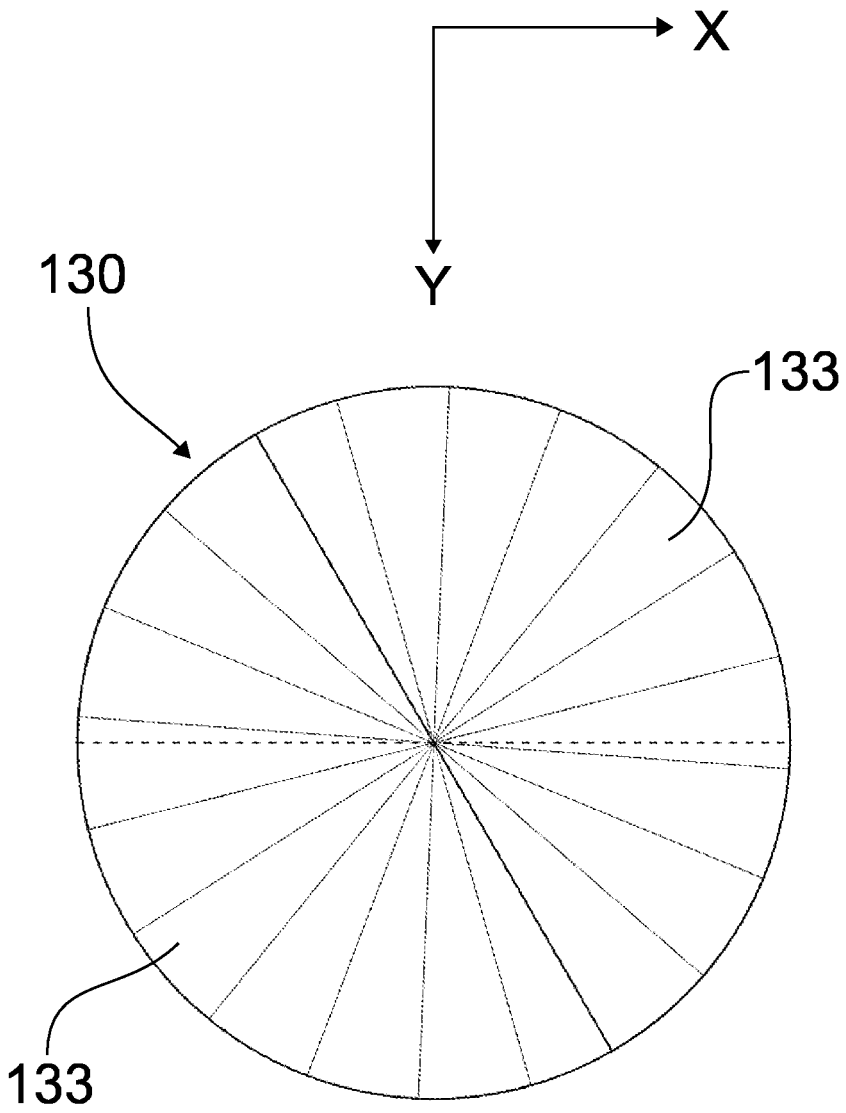
FIG. 5 illustrates an axial elevation view of the sound attenuating element of FIG. 2.

As shown in FIG. 5, the resulting sound attenuating element 130 blocks the view through the enclosure of the sound attenuator. FIG. 5 represents an axial view along the first axis Z, whereby the image represents the sound attenuator in the perpendicular plane formed by a second Cartesian axis X and a third Cartesian axis Y. The components 133 extend radially in respect to the first axis Z. The several revolutions of the helicoid structure ensures that sound attenuator is not see through along the first axis Z.

Figure 4:
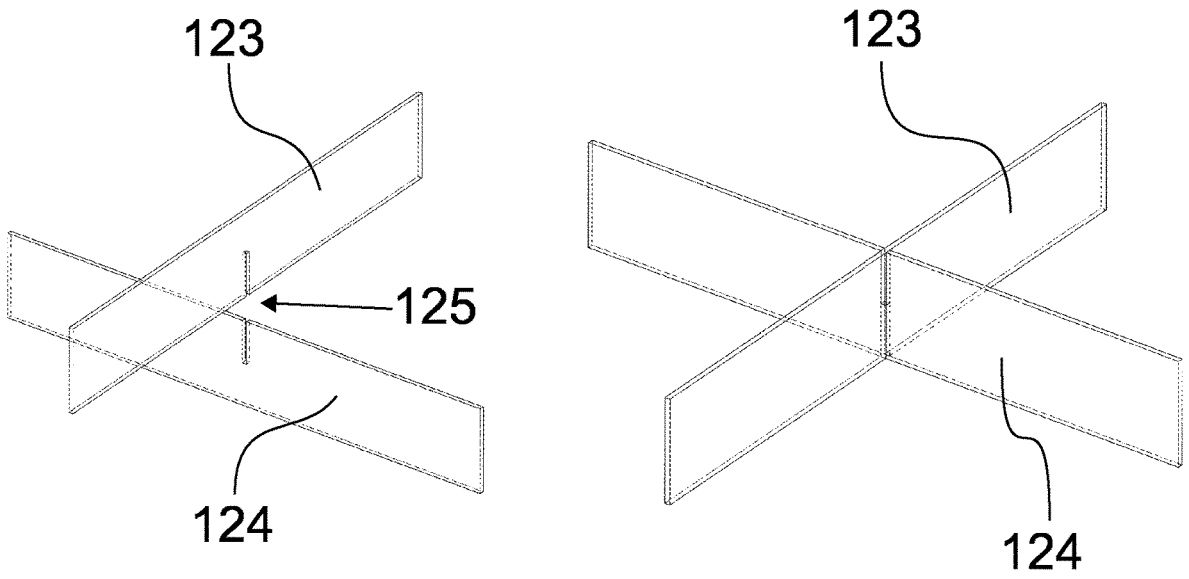
FIG. 4 illustrates the connection between two components of a sound attenuating element in accordance with at least some embodiments.

FIG. 4 shows a sub-assembly sequence for producing one layer of components for the sound attenuating element of FIG. 2. Can be seen, the two components 123, 124 forming one layer extend in a non-straight angle in respect to each other. More generally speaking, the sub-assembly (right image), i.e. layer of components, is formed of two components 123, 124, 133 cross-wise attached to each other. In the specific example of FIG. 4, the components 123, 124 extend in a right angle to each other. The left image of FIG. 4 shows exemplary interlocking shapes 125 provided to the components 123, 124 forming a sub-assembly shown in the right image. As depicted, the interlocking shape 125 may take the form of a notch which is configured to engage another corresponding notch on the other component.

Alternatively (not shown), one component could feature an opening, through which the other component is first inserted and then turned to achieve the sub-assembly.

The isolated sub-assembly features four blades formed by the two crossing inter-connected components 123, 124. Similarly to the embodiment of FIG. 3, the components may contain micro-perforations 122 (shown in enlargement in FIG. 2). In other words, the components 133 may be micro-perforated plates (MPP).

The components, whether being assembled through simple succession (FIG. 3) or from sub-assemblies (FIG. 4), assume the twisted shape upon installation into the enclosure 110 or before introduction into the enclosure 110. As mentioned above, the enclosure 110 includes a guide, which is designed to receiving and holding components that form a sound attenuating element. According to one embodiment, the guide is provided to the inner surface of the enclosure 110, particularly to the inner surface of the envelope. The guide extends through the envelope of the enclosure 110, particularly through the envelope along the greatest dimension thereof. The guide may take the form of a groove or a pair of opposing grooves or a plurality of such pairs.

Figure 6:
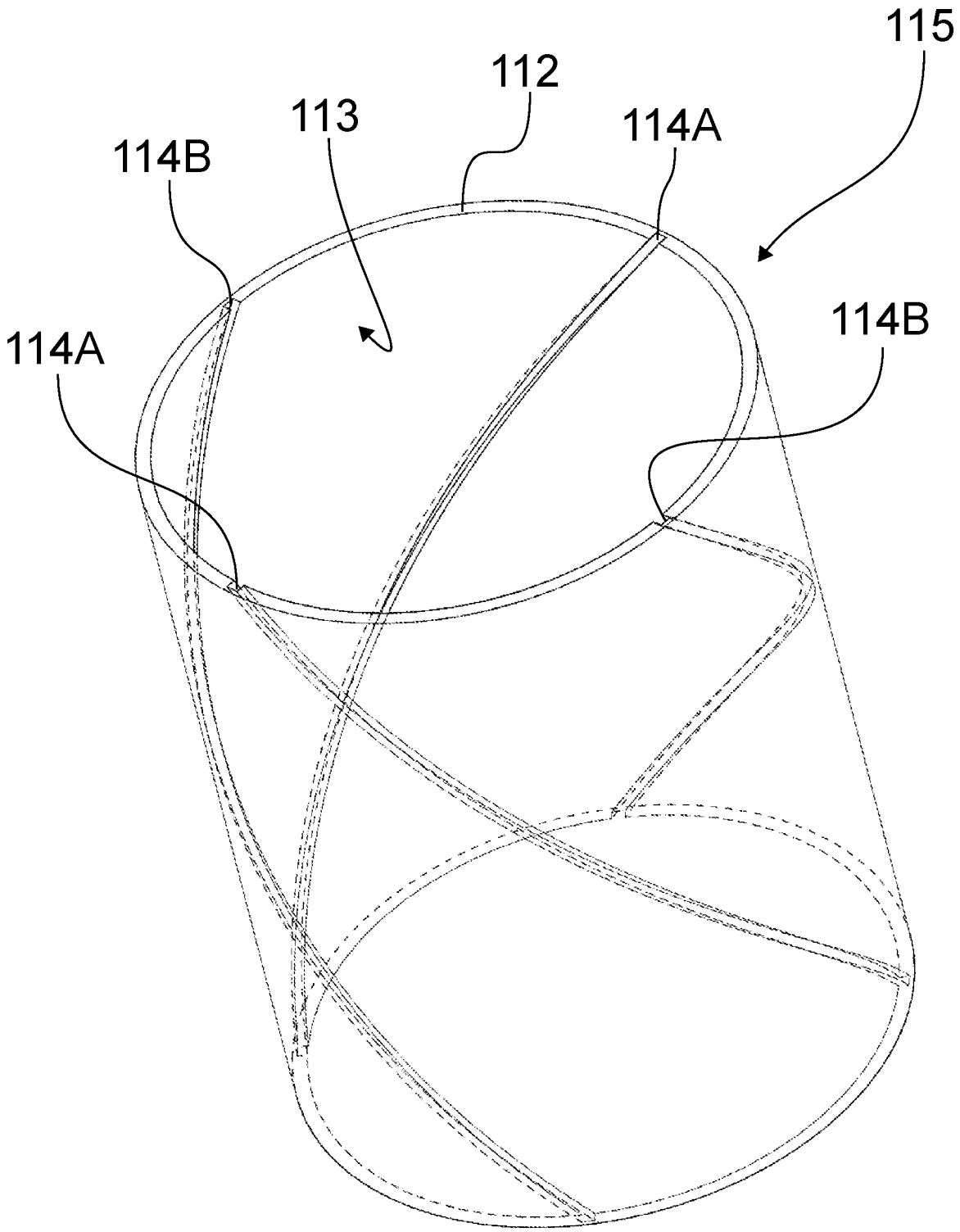
FIG. 6 illustrates a perspective isolated view of the central section of the enclosure of FIG. 1, and FIG. 7 a perspective cut-out view of the enclosure of FIG. 6 for more clearly depicting the spiral nature of the guide running on the inner surface of the enclosure.
Figure 7:
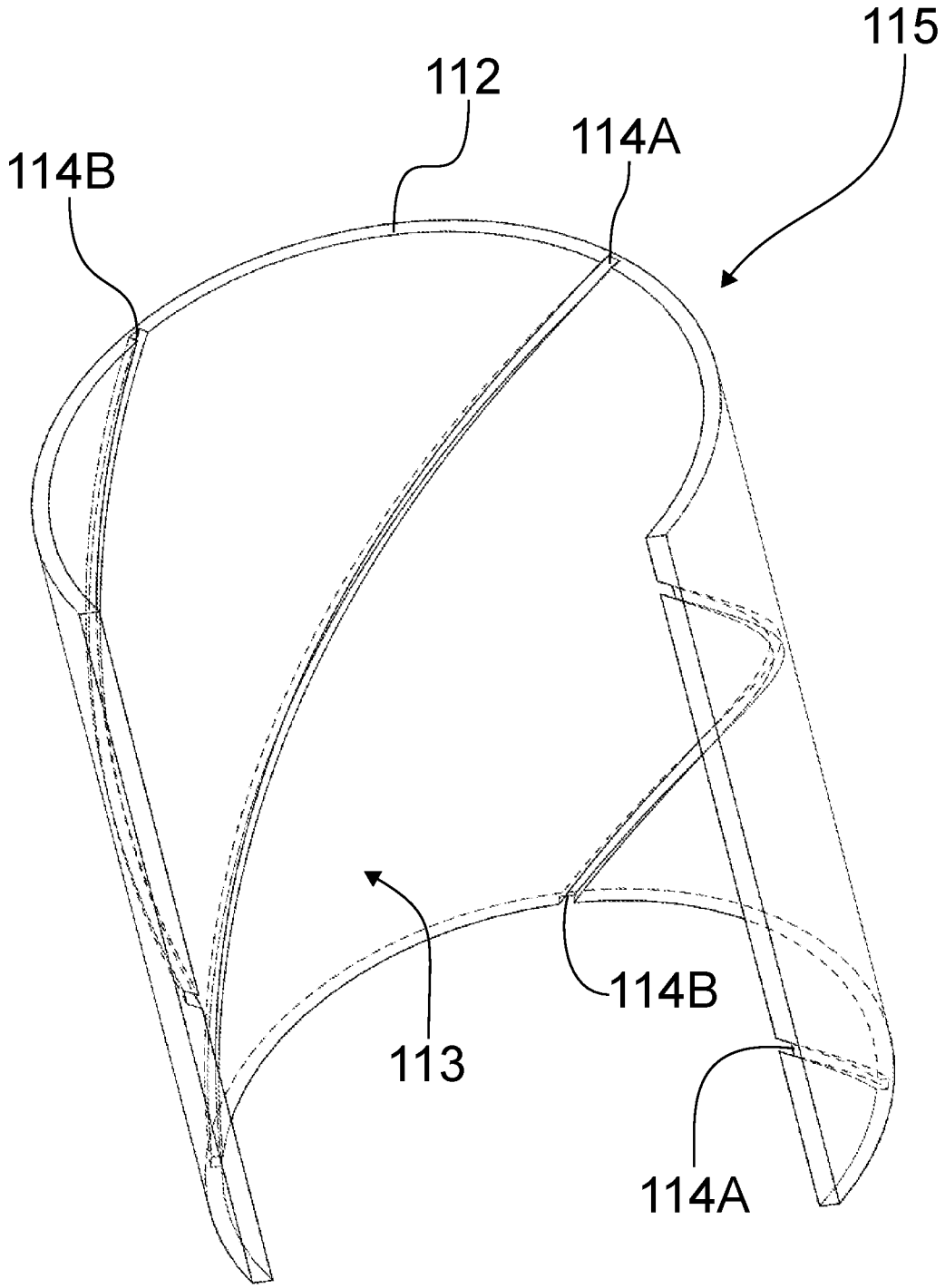

Let us first consider providing a sound attenuator featuring a single-blade sound attenuating element of FIG. 3. To receive such a sound attenuating element 130, the guide of the enclosure 110 features two opposing grooves provided to the inner surface of the enclosure. FIGS. 6 and 7 show an isolated view of the central section 115 of FIG. 1 for highlighting the spiral nature of the guide 114. In the example given in FIGS. 6 and 7 the guide comprises a first groove 114A provided to the inner surface 113 of the body 112 of the enclosure. The groove 114A extends across the length of the enclosure or section 115 of the enclosure. In addition, the groove 114A is curved such that it begins at one point on a cross-sectional circumference of the body 112 and ends at a second point on a cross-sectional circumference of the body 112. FIGS. 6 and 7 also show a second such groove 114A provided on the opposite side of the enclosure. As the start and end points of the opposing grooves 114A are not aligned with each other on the cross-sectional the circumference of the body 112, the opposing grooves 114 create a spiral guide. The pair of first grooves 114A creates a first pair of grooves 114A for receiving the components 133 of a sound attenuating element 130.

A second such pair of grooves 114B may be provided to accommodate a multi-blade sound attenuating element, such as a double-blade element shown in FIG. 2. The second pair of grooves 114B is angularly displaced in respect to the first pair of grooves 114A, e.g. by 90 degrees, depending on the mutual angular displacement of the crossing components 123, 124 of the sound attenuating element 120.

When a component 133 is introduced into the enclosure between the grooves and pushed along the guide along the first axis Z, the spiral shape of the guide bends the components about an axis which is perpendicular to the first axis Z. With several such components 133 layered on top of each other, the sound attenuating element 130 thus formed forms a non-planar ruled surface, such as a helicoid shown in FIG. 3.

Assembly of a multi-blade sound attenuating element 120 of FIG. 2 is constructed in a similar fashion. To receive a cross-wise sub-assembly of two components 123, 124, the guide is made of two pairs of opposing grooves similarly deviated from each other about the first axis. The grooves may receive the sub-assembly of the right image of FIG. 4 at once or individual components 123, 124 of the left image of FIG. 4 in succession so as to connect the components 123, 124 through the interlocking shape 125 within the enclosure. The spiral shape of the guide, i.e. the grooves, twist the components about an axis perpendicular to the axis of succession, wherein a non-planar ruled surface is formed. In the example of FIG. 2, the shape is a double-helicoid. Alternatively, the components may be twisted prior to introducing them into the guide.

As shown in FIG. 1, the enclosure 110 may include sections having a reduced cross-section. In the example, the enclosure 110 features a central section 115 having a large cross-section and two end sections 116 having a reduced cross-section that tapers or otherwise transitions from the large cross-section of the central section 115 to the flange 111. The enclosure 110 may include a lead pipe 117, such as a straight pipe section of uniform cross-section, connecting the flange 111 and the end section 116. The sound attenuator 100 may therefore be constructed from respective three sections by first assembling the components in the detached sections of the enclosure and then joining the section to each other by welding or similar method.

Several alternative embodiments to the ones described above may be envisioned. For example, instead of the guide comprising grooves on the inside of the enclosure, the guide could go through the wall of the envelope (not illustrated). The spiral sections of the enclosure could be held together by external supports, such as brackets or bands. The fit between the sound attenuating element and the enclosure would be tight and ensured by a seal there between.

According to an alternative embodiment (not illustrated), the interface between the guide and the components of the sound attenuating element is reversed. The groove, i.e. the female part of the interface, on the inner surface of the enclosure could instead be a protuberance or a similar male part of the interface. The protuberance would extend in a spiral similarly to the groove according to the illustrated embodiments. Similarly, the inner surface of the enclosure would feature one or several pairs of opposing protuberance depending on the number of blades on the sound attenuating element. Conversely, the sound attenuating element, particularly the components thereof, would feature a slot or other suitable female part of the interface that would engage the spiral protuberance of the enclosure. The slot can be added as a simple depression at the end surface of the component or it can be a fork-like element extending from the end of the component.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

INDUSTRIAL APPLICABILITY

The herein proposed solution may find industrial application in exhaust systems employed e.g. in vehicles or power plants having internal combustion engines, ventilation systems, etc.

ACRONYMS LIST

MPP micro-perforated plate

REFERENCE SIGNS LIST

| No. | Feature |
|---|---|
| 100 | sound attenuator |
| 110 | enclosure |
| 111 | flange |
| 112 | body |
| 113 | inner surface |
| 114 | guide |
| 115 | central section |
| 116 | end section |
| 117 | lead pipe |
| 120 | attenuating element |
| 121 | contacting surface |
| 122 | micro-perforation |
| 123 | component |
| 124 | component |
| 125 | interlocking shape |

-continued

| REFERENCE SIGNS LIST | |
|---|---|
| No. | Feature |
| 130 | attenuating element |
| 131 | contacting surface |
| 133 | component |
| X | first dimension |
| Y | second dimension |
| Z | third dimension |

CITATION LIST

Patent Literature

CA 2094168 A1
GB 694376 A

The invention claimed is:

1. A sound attenuating element, which is formed at least in part by an assembly of a plurality of components, which:
- are successively connected to each other along a first axis,
- each exhibit an elongated shape such that a dimension of elongation extends perpendicularly to the first axis thereby forming an axis of elongation,
- are each bent along the axis of elongation to exhibit a curved shape, and which
- form at least one non-planar ruled surface when assembled, wherein every second component in the assembly extends in a non-straight angle, in respect to the successive component, wherein the components are elongated plates that are successively layered in the assembly,
- wherein the components comprise interlocking shapes to form a cross-wise subassembly of two interlocking components.

2. The sound attenuating element according to claim 1, wherein the components comprise micro-perforations.

3. The sound attenuating element according to claim 1, wherein the plurality of components are successively connected along a first axis so as to form a helicoid.

4. The sound attenuating element according to claim 3, wherein the components are each curved about an axis which is perpendicular to the first axis.

5. The sound attenuating element according to claim 1, wherein each layer of components is formed of two components attached to each other cross-wise.

6. The sound attenuating element according to claim 1, wherein the interlocking shape is a notch, wherein the notch is configured so that the cross-wise subassembly is arranged so that edges of the plates, which are perpendicular to the first axis, are coplanar.

7. The sound attenuating element according to claim 1, wherein the sound attenuating element is configured to be installed in a duct.

8. The sound attenuating element according to claim 1, wherein the components in the assembly exhibit a shorter dimension along the first axis than in a dimension perpendicular to the first axis.

9. An enclosure for a sound attenuator, comprising:
- several spiral guides, which are configured to receive a plurality of components in a successively layered fashion so as to create at least one non-planar ruled surface for contacting a gaseous current,
- a first set of mutually opposing guides comprising a first and second guide, each guide configured to receive a respective opposing end of an elongated component to extend between the guides, and
- a second set of mutually opposing guides comprising a third and fourth guide, each guide configured to receive a respective opposing end of an elongated component to extend between the guides,
- wherein the two sets of opposing guides are angularly offset from each other about a first axis, wherein the two sets of opposing guides are configured to receive cross-wise subassemblies of two components along a first axis as a sound attenuating element covering an inner space defined by the enclosure when viewed along the first axis.

10. The enclosure according to claim 9, wherein the guide is a groove.

11. The enclosure according to claim 10, wherein the groove is provided to an inner surface of the enclosure.

12. The enclosure according to claim 11, wherein the guide is configured to bend the components.

13. The enclosure according to claim 11, wherein the guide is configured to bend the components so as to form a helicoid.

14. The enclosure according to claim 9, wherein the components are plates that are elongated in an elongation dimension, wherein the guide is configured to bend the components about said elongation dimension.

15. A sound attenuator, comprising:
- an enclosure, which comprises:
  - several spiral guides, which are configured to receive a plurality of components in a successively layered fashion so as to create at least one non-planar ruled surface for contacting a gaseous current,
  - a first set of mutually opposing guides comprising a first and second guide, each guide configured to receive a respective opposing end of an elongated component to extend between the guides, and
  - a second set of mutually opposing guides comprising a third and fourth guide, each guide configured to receive a respective opposing end of an elongated component to extend between the guides,
- wherein the two sets of opposing guides are angularly offset from each other about a first axis, wherein the two sets of opposing guides are configured to receive cross-wise subassemblies of two components along a first axis, and
- a sound attenuating element installed into the enclosure, which sound attenuating element is formed at least in part by an assembly of a plurality of components, which:
  - are successively connected to each other along the first axis,
  - each exhibit an elongated shape such that a dimension of elongation extends perpendicularly to the first axis,
  - are each bent along the axis of elongation to exhibit a curved shape, and which
  - form at least one non-planar ruled surface when assembled,
- wherein every second component in the assembly extends in a non-straight angle, e.g. a right angle, in respect to the successive component.

16. The sound attenuator according to claim 15, wherein the sound attenuator is an in-duct attenuator.

17. The sound attenuator according to claim 15, wherein:
- the sound attenuator is elongated along the first axis, and wherein the sound attenuating element covers an inner space defined by the enclosure when viewed along the first axis.

18. A method of producing a sound attenuator comprising:

providing an enclosure, which comprises:

several spiral guides, which are configured to receive a plurality of components in a successively layered fashion so as to create at least one non-planar ruled surface for contacting a gaseous current, a first set of mutually opposing guides comprising a first and second guide, each guide configured to receive a respective opposing end of an elongated component to extend between the guides, and a second set of such mutually opposing guides comprising a third and fourth guide, each guide configured to receive a respective opposing end of an elongated component to extend between the guides, wherein the two sets of opposing guides are angularly offset from each other about a first axis, wherein the two sets of opposing guides are configured to receive cross-wise subassemblies of two components along the first axis, providing a sound attenuating element formed at least in part by an assembly of a plurality of components, which:

are successively connected to each other along the first axis, each exhibit an elongated shape such that a dimension of elongation extends perpendicularly to the first axis, are each bent along the axis of elongation to exhibit a curved shape, and which form at least one non-planar ruled surface when assembled, wherein every second component in the assembly extends in a non-straight angle, e.g. a right angle, in respect to the successive component, and installing the sound attenuating element into the guide of the enclosure so as to form a non-planar ruled surface for contacting gaseous currents.

19. The method according to claim 18, wherein the installment of the sound attenuating element comprises introducing individual components or individual sub-assemblies of cross-wise connected components into the guide of the enclosure in a successive fashion.

* * * * *